US006082816A

United States Patent [19]

Gottlieb et al.

[11] Patent Number: 6,082,816

[45] Date of Patent: Jul. 4, 2000

[54] CHAIR STORAGE UNIT

[75] Inventors: Jeremy D. Gottlieb, Beachwood; John Hoffman, Brunswick, both of Ohio; Lester J. Rosensaft, Bedminster, N.J.

[73] Assignee: The Jeremy Group, Beachwood, Ohio

[21] Appl. No.: 08/946,926

[22] Filed: Oct. 8, 1997

[51] Int. Cl.[7] ..... A47C 7/62

[52] U.S. Cl. ..... 297/188.1; 297/188.12; 297/188.13; 297/DIG. 6

[58] Field of Search ..... 297/188.2, 188.01, 297/188.07, 188.06, 188.08, 188.09, 188.1, 188.12, DIG. 6; 224/275; 190/100, 109; 150/113

[56] References Cited

U.S. PATENT DOCUMENTS

| | | |
|---|---|---|
| 1,304,753 | 5/1919 | Dwyer . |
| 1,829,486 | 10/1931 | Kimbrig et al. . |
| 2,853,219 | 9/1958 | Schwartz . |
| 2,865,433 | 12/1958 | Warner . |
| 3,088,771 | 5/1963 | Weigle . |
| 3,120,404 | 2/1964 | Bramming . |
| 3,151,909 | 10/1964 | Gerdetz . |
| 3,587,795 | 6/1971 | Berry et al. . |
| 3,613,843 | 10/1971 | Davis . |
| 3,632,029 | 1/1972 | Sonner . |
| 3,958,616 | 5/1976 | Beverstock . |
| 4,131,313 | 12/1978 | Jacobs . |
| 4,186,504 | 2/1980 | Avery . |
| 4,453,623 | 6/1984 | Horii . |
| 4,783,120 | 11/1988 | Kiechlin . |
| 4,842,329 | 6/1989 | Owens . |
| 4,854,637 | 8/1989 | McCree . |
| 5,050,767 | 9/1991 | Peer . |
| 5,190,344 | 3/1993 | Anderson et al. . |
| 5,421,637 | 6/1995 | Lemburg . |
| 5,490,712 | 2/1996 | Drelick . |
| 5,516,193 | 5/1996 | Simpson . |
| 5,573,288 | 11/1996 | Raffensperger . |

FOREIGN PATENT DOCUMENTS

| | | |
|---|---|---|
| 1171746 | 1/1959 | France . |

*Primary Examiner*—Milton Nelson, Jr.
*Attorney, Agent, or Firm*—Dickstein Shapiro Morin & Oshinsky LLP

[57] ABSTRACT

An under-seat storage device made of an expandable material which in a first embodiment comprises an accordian-shaped configuration. Other embodiments include Spandex rope or other mesh type fabrics having other expandable qualities. The material has a top portion having a plurality of VELCRO® strips clips, magnet(s), screws, bolts, adhesive, wing-nuts, etc. attached thereon, three side portions having accordion folded or other expandable surfaces and a front portion having an articulable flap which opens towards a bottom portion, and a VELCRO® (or other fastening material) strip in the center thereof. A plurality of VELCRO® strips are also located on the bottom of a folding seat such that the storage unit may be readily attached and/or detached from the bottom of the seat by pushing the VELCRO® strips together or pulling them apart. The storage unit may also include a smaller center container attached to the storage envelope. The smaller container may be made of a clear or translucent plastic which can be separately attached to the storage container by means of VELCRO®, rubber cement, clips, magnets, snaps, screws, bolts, wing-nuts, etc. or can slide into the storage device. Finally, the storage container can be completely portable and disposable.

16 Claims, 6 Drawing Sheets

CHAIR STORAGE UNIT

FIELD OF THE INVENTION

The present invention relates to permanent, semi-permanent, portable and/or attachable seat storage devices which are designed to fit and attach to the bottom of chairs.

BACKGROUND OF THE INVENTION

Folding chairs have long been the standard for most forms of mass seating. Whether it be the theater, a sporting event, a stage event or a lecture hall, spring-loaded folding seats where the base cushion/seat is urged upwards when the participant is not seated has become the standard throughout the world. That popularity is logical: folding seats enable large numbers of people to be packed into a relatively tight space and yet have sufficient comfort to keep people seated for long periods of time. A drawback to folding seats is that they do not permit for easy storage of various personal items, programs, etc. Instead, such items often end up on laps, in the aisles, or require the use of a remote locker. Such alternative obviously add inconvenience and cost. Moreover, existing designs fail to address the inherent danger from providing storage that readily conceals content. For example, in stationary chairs, such as those commonly used in schools, a basket can be provided under the legs of the chair for storage of books, etc. Such an arrangement in a folding chair would render the chair inoperable or largely inconvenient from a storage standpoint.

To overcome such drawbacks, there have been over the years, attempts to provide a storage alternative. Indeed, a number of these attempted solutions have also been patented. For example, U.S. Pat. No. 5,573,288 to Raffensperger discloses a portable seat cushion and storage device that can be attached to a folding chair. VELCRO® hook and loop fasteners are employed to releasably attach the cushion storage member to the seat. A disadvantage of Raffensperger, however, is that it requires installation by the user, and it is not plausibly used for permanent storage. Further, to use this arrangement requires a fairly involved operation where the user has to wrap the device around the seat, hold the storage unit to the bottom of the seat and then reconnect the cushion to the storage device from the back of the seat. In a mass seating situation, that amount of work can easily cause traffic jams.

Another much simpler arrangement is disclosed in U.S. Pat. No. 5,490,712 to Drelick. The Drelick patent discloses a closable storage container for removable attachment to the bottom of a stadium seat. The Drelick container is suspended below the seat when in use and is held to the seat by means of a strap (much like a strap for a pocketbook). However, Drelick provides a construction which must be removed from the stadium by the user. If forgotten, valuable articles may be left behind. Moreover, the container in Drelick is effectively shaped like a box which does not yield when objects larger than the dimensions of the box are placed in the container. Finally, there is no ability for the user to see into the Drelick storage compartment. Thus, items could be easily left behind.

Another patent of some interest is U.S. Pat. No. 1,829,486 to Kimbrig, et al. Kimbrig appears to disclose pivotal theater seats combined with rope mesh containers positioned underneath those seats for storing articles. In Kimbrig, a fabric mesh is attached to the seat by means of a metal frame. However, the unit is not removable or portable by a user or stadium attendant.

Finally, there are a number of storage devices disclosed in U.S. Pat. Nos. 4,854,637, 4,521,637, 4,131,313, 3,151,909 and 2,865,433 which are designed to be foldable and act as both seat and storage device. Most of these devices, however, provide envelopes or pockets which are located at the front of the seat. Thus, these pockets may cause some seating discomfort, may be awkward to use, and may result in articles dropping out of the pockets if the person using the seat moves his or her legs the wrong way.

Finally, in addition to the above-noted deficiencies, several other problems exist with respect to under seat storage that are not met by the above-noted references. First, there is a lack in the art of under seat storage devices that can be permanently fixed to the bottom of the seat, yet are readily removable. Additionally, there is no available under-seat storage devices which (1) are readily expandable depending on the amount of material provided therein; (2)) can be permanently or semi-permanently installed quickly and inexpensively; (3) are designed with flexible materials, thus making the storage units applicable to any type of surface material such as a roughened surface, as well as contour, whether it be planar, curved or angular; (4) are transparent so as to provide the user with access to information such as advertising or promotions; (5) are easily cleaned out by a hose without requiring any additional operations by stadium crews; (6) are usable in spite of inclement weather and (7) include a pocket which is either clear or has a window and which is either separately releasable or permanently affixed to the storage container, such pocket permitting the display of materials contained therein, such as promotions, programs, samples, etc.. Moreover, the flexible material can be adhered to such surface through one of a variety of attaching means, making installation highly inexpensive and easy to accomplish. Finally, there is a need in the art for a seat storage device that can be made inexpensively and can also allow printing or embossing thereon by advertisers, stadium or theater authorities, or others.

SUMMARY OF THE INVENTION

In view of the foregoing, there exists a need in the art for an invention which satisfies one or more of the above identified objectives. It is a primary object of the invention to provide an article storage device which allows a user to transport the device, attach it to the underside of a seat, expand the device in use or contract the device for transport, see through the device for such items as advertising and remove the device, at the user's option and/or the owner's option. It is a further object of the invention to provide a universally applicable under seat storage device which is flexibly attachable to the bottom of a seat having any type of contour and which can be attached to the seat through either VELCRO®, screws, bolts, clips magnets, adhesives, wing-nuts, screws and matching key-hole slots, or other appropriate fastening devices or substances.

Moreover, it is an object of the invention to provide an under seat storage device where permanent installation is an option, or semi-permanent installation is an option, or entirely removable installation is an option.

It is yet another object of the device to provide a mounting unit for an under seat storage device whereby the storage device is held to the seat by means of any number and any type of fastening substances or fastening devices, such as magnet(s) which provide metal-to-metal connection(s).

It is a further object of the invention to provide under-seat storage which is expandable, such as an accordion shaped container and which can differentially expand in order that an interior portion of the expandable material (i.e., closest to the back of the seat) expands farther than a forward portion of the envelope (closest to the front of the seat) such that when the seat is upright, passage in front of the seat is not restricted.

It is a further object of the invention to provide an under seat-storage unit which is made from transparent plastic having multiple openings therein to allow for drainage when washed or during inclement weather, etc.

It is another object of the invention to provide an under seat storage unit made from material, such as mesh cloth, and having plastic or the like tops and bottoms to which the material is connected along the sides thus allowing the under seat storage unit to be washed, and allowing it to be breathable and yet have sufficient structural strength to hold heavy objects.

It is a further object of the invention to provide an under seat storage device made entirely of Spandex or other material having similar properties having a plastic top attached thereto so as to allow the Spandex, etc. envelope to expand differentially toward the back.

It is yet a further object of the invention to provide a seat storage unit in which some or all of the material is an insulating material in order that the temperatures of items placed in the storage unit can be maintained when stored.

Briefly described, these and other objects of the invention are accomplished by means of an under-seat storage device made of an expandable material for example comprising an accordian-shaped configuration, Spandex or other expandable material. The material has a top portion having a plurality of VELCRO® strips clips, magnet(s), screws, bolts, adhesive, wing-nuts, etc. attached thereon, three side portions having accordion folded surfaces and a front portion having an articulable flap which opens towards a bottom portion, and a VELCRO® (or other fastening material) strip in the center thereof. A plurality of VELCRO® strips are also located on the bottom of a folding seat such that the envelope may be readily attached and/or detached from the bottom of the seat by pushing the VELCRO® strips together or pulling them apart. The storage envelope may also include a smaller center container attached to the storage envelope. The smaller container may be made of a clear or translucent plastic which can be separately attached to the storage envelope by means of VELCRO®, rubber cement, clips, magnets, snaps, screws, bolts, wing-nuts, etc. or can slide into the storage device. Finally, the envelope can be completely portable and disposable, and made of a low cost material such as Tyvek.

These and other objects and advantages of the invention shall now be described herein with respect to the drawings which are attached hereto as well as the detailed description of the invention and claims.

DETAILED DESCRIPTION OF THE PREFERRED EMBODIMENTS

Figure 1:
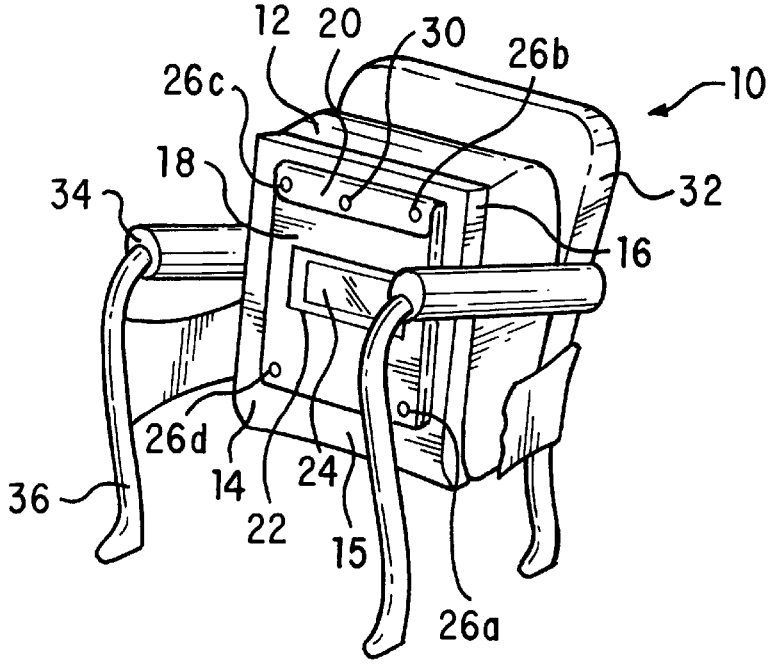
FIG. 1 is a perspective view of a first embodiment of the present invention with the device secured to a stadium seat.

Referring now to the diagram wherein like reference numerals refer to like objects, FIG. 1 is a perspective diagram of a first embodiment of the invention mounted on a stadium chair 10. As shown, the chair 10 includes standard components including a seat back portion 32, arms 34, legs 36 and a seat base 12. The seat portion is articulable up and down so that when an individual wishes to use the seat, the user may push the chair seat 12 down as is known so that the seat remains substantially horizontal relative to the stadium floor. The seat base can, for example, include a cushion portion 12 and a frame portion 16. However, any conventional kind of stadium or auditorium seating can be used. Therefore, the base portion of the seat can also have no cushion, a substantial cushion or a frame made out of any one of a number of materials including plastic, wood, and/or metal. The seat frame includes a bottom portion 14 which, when the chair is not occupied, can be articulated into a substantially upright position.

As illustrated in FIG. 1, the first embodiment of the present invention comprises a device 18 which includes a storage compartment (not shown) that is designed to be attached to the seat's bottom surface 15. The storage device 18 is attached to the seat by means of a plurality of connection members 26A–D. The connection members 26A, 26B are capable of making the storage device 18 readily detachable/attachable to the seat. Alternatively, members 26A, 26B can be permanent connecting members instead. The storage device 18 also includes an enclosure 20 with a closing means 30 as well as a connecting cover envelope 22 having a window portion 24 for providing a detachable envelope capable of storing appropriate material, such as advertising, flyers, score sheets, librettos, team logos, color or messages etc.

As shown, the storage member 18 is designed to provide under seat storage for stadium/theater type seating. The storage member is designed so that it can be attached only to the bottom of the seat so as not to impair or intrude upon the user's comfort, as well as provide any kind of obstruction to those who must pass in front of the seat.

Figure 2A:
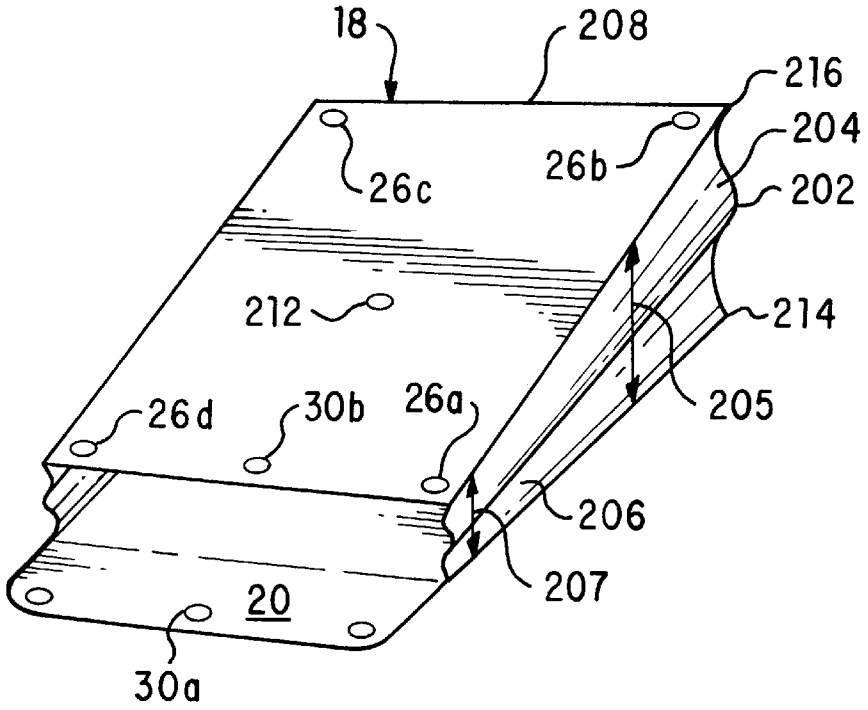
FIGS. 2*a* and 2*b* are perspective views of the first embodiment of the device shown in FIG. 1 with a flap open and detachable envelope not shown.

The storage unit is shown in more detail with regard to FIG. 2. Specifically, storage unit 18, as shown as FIG. 2, is made entirely of a flexible plastic material. However, the storage unit can comprise any known material having a sufficient degree of flexibility and transparency. Furthermore, the material can be insulative in nature in order that the temperature of the material in the storage container is maintained at a desired level despite the weather or building conditions. The plastic or like material can be transparent so as to provide a user with an indication that the envelope contains items therein. As a consequence, the user is less apt to forget what they have stored under their seat, and for safety purposes, security can readily view any potentially harmful items left under chairs. Moreover, if promotional materials are contained in the envelope, its transparency obviously promotes access to that information. It should be noted, for example, that the storage container 18 can be made of an inexpensive, disposable material, such as Tyvek, or can be releasably and flexibly attached not only to a seat bottom, but to the back of the seat, a wall, column, seat side, or any other desired surface.

Figure 2B:
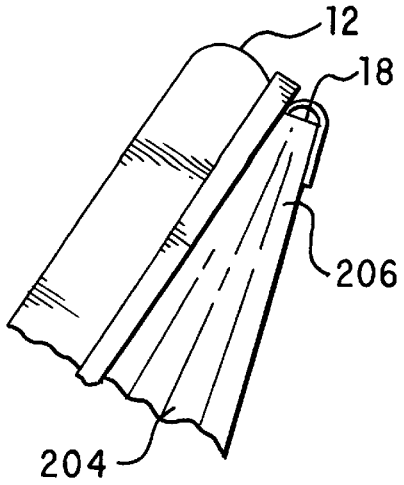

In addition to the plastic material, the storage unit 18 includes an accordion shaped side portion 202. The accordion shape is differentially expandable such that towards the front portion of the envelope 20 the storage container 18 will expand up to the distance 207 as indicated by the arrows. On the other hand, towards the rear portion 208 of the storage container 18, the expansion will be at a much farther distance 205. The importance of the differential expansion of the accordion container is illustrated in FIG. 2B. As shown in that diagram, the seat 12 is in a substantially upright unoccupied position. In this position, the storage container 18 is differentially expandable such that the bottom portion 204 expands less than the top portion 206. A closing means, such as VELCRO®, adhesive, snap or any other appropriate reclosable attaching device 212 is located in the center of the accordion container. In use, this attaching means may be used to close the container when it is empty by pressing the center of that container. As a result, a distended container can be compressed back to a position where it remains relatively flush with the seat's bottom surface. As a consequence, due to the angle of the upright seat, the storage envelope 18 does not impede a passerby. Moreover, the flexible configuration ensures that the maximum amount of storage space is maintained since larger objects can be stored toward the rear portion 208 of the container 18.

A further feature of the container 18 is that its rear portion 208 includes at least one opening along the right and/or left bottom rear corners 214 and right and/or left top rear corners 216 (left sides are not illustrated) to provide drainage of the container when that container is flooded. As a result, permanently or semi-permanently installed containers can be cleaned out by a hose, snapped back into a closed position, and still continue to drain water because the upright position of the seat induces flow toward the rear corners 214, 216. Such drainage also has obvious advantages if the containers are exposed to rain, snow, spillage, etc.

Referring back to FIG. 2A, the storage container 18 is attached to the chair bottom portion 14 by means of a plurality of attaching means 26A–26D. The attaching means can consist of a number of different types of devices. For example, each can comprise an anchor bolt (not shown) threaded through an appropriately sized washer. The anchor bolts are of a sufficient height so that when inserted into the chair bottom portion 14 they do not impact on the user through the cushion or the seating surface of the chair. Alternatively, the attaching units can comprise double-sided mounting tape or mounting squares. The mounting squares, for example, can be those sold by Minnesota Mining and Manufacturing. Another material for the attaching means can be VELCRO®. However, if VELCRO® is used, a corresponding VELCRO® mating piece would need to be attached to the bottom portion 14 of the seat 10. Finally, if metal seat frames and seat bottom portions 14 are used, then the attaching means can also comprise a plurality of magnets which can be bonded to the storage container 18. Magnets of sufficient strength are highly desirable for a metal framed chair inasmuch as they can be very easily attached to the bottom of the chair, and do not require alignment to a particular part of the bottom of the chair. For example, the magnet arrangement would have an advantage over the VELCRO® arrangement which requires alignment with the VELCRO®.

Figure 3A:
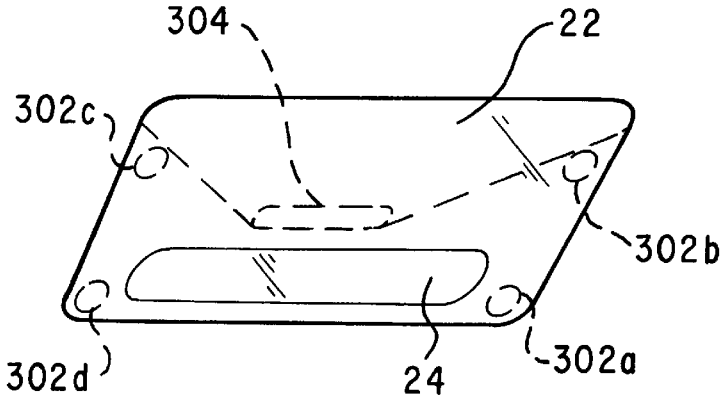
FIG. 3*a* is a perspective view of the detachable envelope that can be attached to the front of the main storage unit shown in FIG. 2.

Referring now to FIG. 3, a perspective diagram of the cover container 22 is shown. The container or folder 22 can be formed of a similar folded arrangement to a standard mail envelope or for that matter any other suitable transparent cover for material. However, the container/sheath can be made of a completely transparent or translucent plastic so as to insure long term durability. The container/sheath is attached to the storage container by means of four attaching means 302A–D. The container/sheath also includes a clasping means 304 which can consist of a VELCRO® or appropriate metal snap and/or plastic clasp arrangement or magnet(s), clips, screws, bolts, wing-nuts, adhesive on any other appropriate fastening device or substance. Finally, the container/sheath should be readily reclosable in use. The container/sheath may include the window portion 24. For example, if the container/sheath is of a translucent, or solid material, which does not allow the user to easily determine what is contained therein, the window portion 24 can be used as shown in the art to show appropriate portions of what is contained in the container/sheath.

Figure 3B:
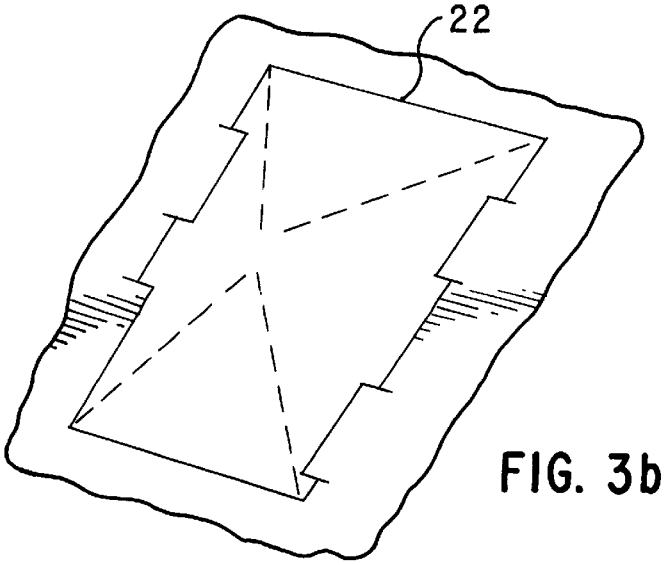
FIG. 3*b* is a perspective cut-away diagram of one embodiment of the mounting for the envelope.

The container/sheath, in use, may be an item that is designed to be readily attached by means of attachments 302A–D to the storage container 18. An example of its application, would be in a situation such as a handout or advertising sheet at a sporting event. For example, promotional material can be placed in the transparent container/sheath and handed out to users at the game or mounted on the underside of the seats before a game. Thus, when the user goes to his/her particular seat, a piece of promotional material is visible to the user before they put their seat back down. Thus, advertising is located at the point where the user is most likely to see it, and use it. Since the container/sheath can be mounted on the storage container 18 by means of the detachable mounting 302A–D, such as VELCRO® or snaps or a double-sided tape or adhesive, magnets, etc., the envelope can be readily attachable/detachable from the storage container 18, and/or have the ability to slide onto the storage container 18 (as shown in FIG. 3*b*), and/or have a slot or opening to place the advertising/promotional materials or the like on the storage container 18.

Figure 4:
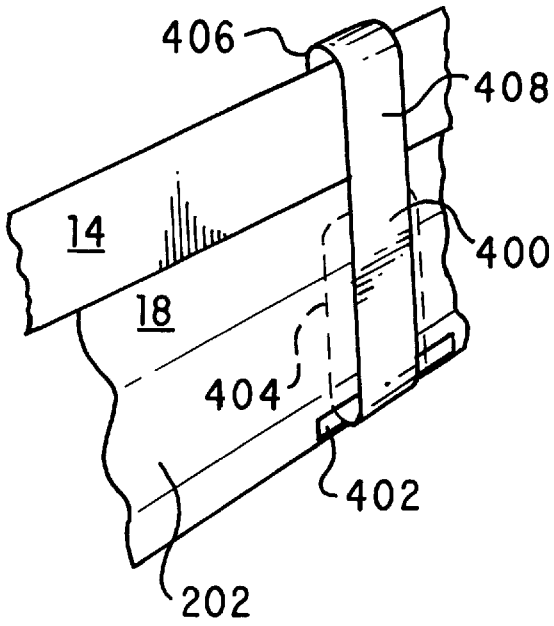
FIG. 4 is a cutaway side perspective view showing a mounting clip type product that can be used to mount the storage device shown in FIG. 2.
Figure 5:
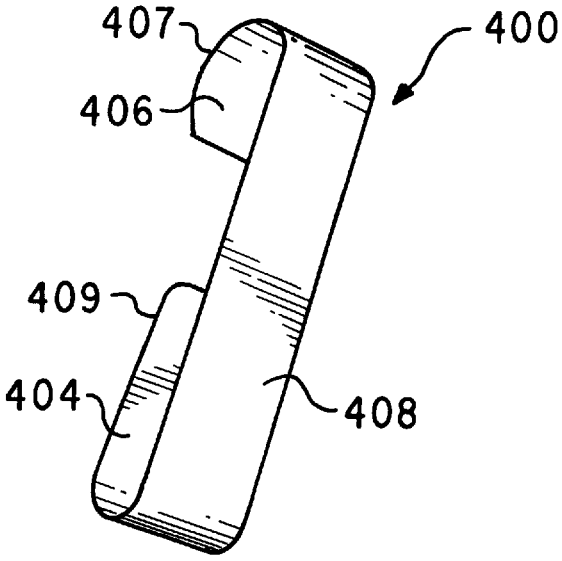
FIG. 5 is a perspective view of the mounting clip illustrated in FIG. 4.

Referring now to FIG. 4 and FIG. 5, an alternative embodiment is shown for an attaching means to connect the storage container 18 to the bottom portion 14 of the chair 10. As shown in FIG. 4, a clip number 400 is designed so as to clip the storage container 18, at appropriate points, to the chair's bottom portion 14. As shown, the clip 400 is designed to be inserted through a slot 402 along the side 202 of the container 18. An inner portion 404 clips to the interior of the container 18. An upper folded portion 406, on the other hand, is designed to clip on to the side of the chair frame. The distance of the front portion 407 from the main portion 408 of the clip is farther than the distance of the lower folded portion 409 from the main portion of the clip 408. (See FIG. 5). As a result, the upper portion 406 of the clip 400 is adapted to fit different sized frames 14. It should be noted that the slit 402 can be reinforced by an appropriate washer, or reinforcing material.

Figure 6:
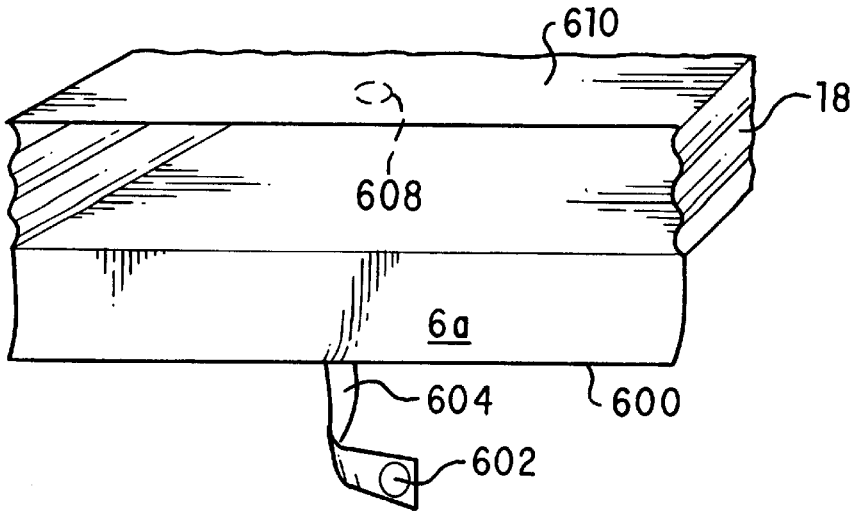
FIG. 6 is a perspective view of a first embodiment of a closure arrangement which may be used with the preferred embodiments of the invention.

Referring now to FIG. 6A, an alternative embodiment for a closure for the container 18 is shown. A flap 600 is provided with a strap 604. An underside portion of the flap 600 has a VELCRO® tab or metal/plastic snap, magnet adhesive, etc., located thereon. The VELCRO® tab is positioned in such a manner so that it can contact with an equivalent-sized VELCRO® tab located on the underside of the upper portion 610 of container 18. AVELCRO® piece 608 pulls the flap up and over the material contained within storage container 18.

Figure 7:
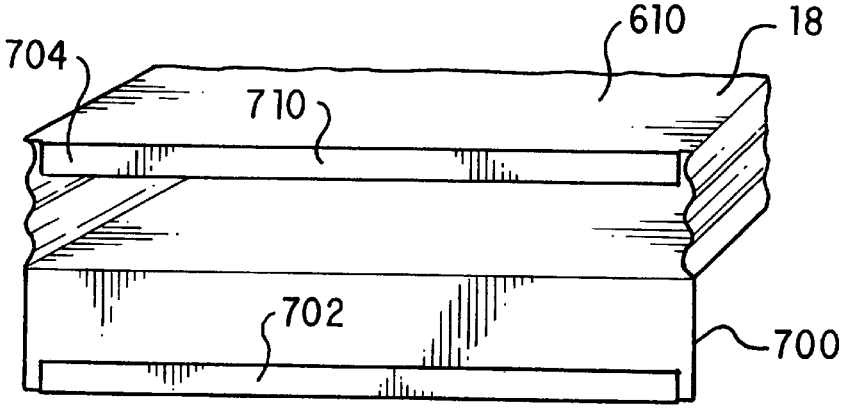
FIG. 7 is a perspective view of a second embodiment of a closure arrangement for the present invention.
Figure 8:
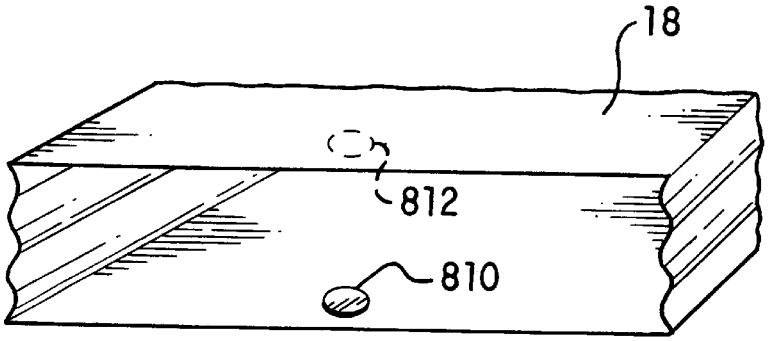
FIG. 8 is a perspective view of a third embodiment to the closure arrangement which may be used for the present invention.

A third embodiment of the closure is shown in FIG. 7. In that figure, VELCRO® material or metal/plastic snap, magnet adhesive, etc., 702 is located across the entirety of the lower flap 700 and upper flap 704 is positioned along the top portion 610 of envelope 18. The upper flap contains a VELCRO® strip or metal/plastic snap, magnet, adhesive etc., 710 which extends substantially across the upper flap of 704. As a consequence, closure of the flap occurs by abutting VELCRO® surface 702 to VELCRO® surface 710 so that a seal across the entirety of the closure is achieved. Finally, FIG. 8 illustrates a third embodiment of the closure. In this embodiment a lower VELCRO® pad or metal/plastic snap, magnet, adhesive, etc., 810 is designed to abut against an upper VELCRO® pad 812 so that when the user presses the two surfaces together, they are adhered so as to easily close the storage container 18.

Figure 9:
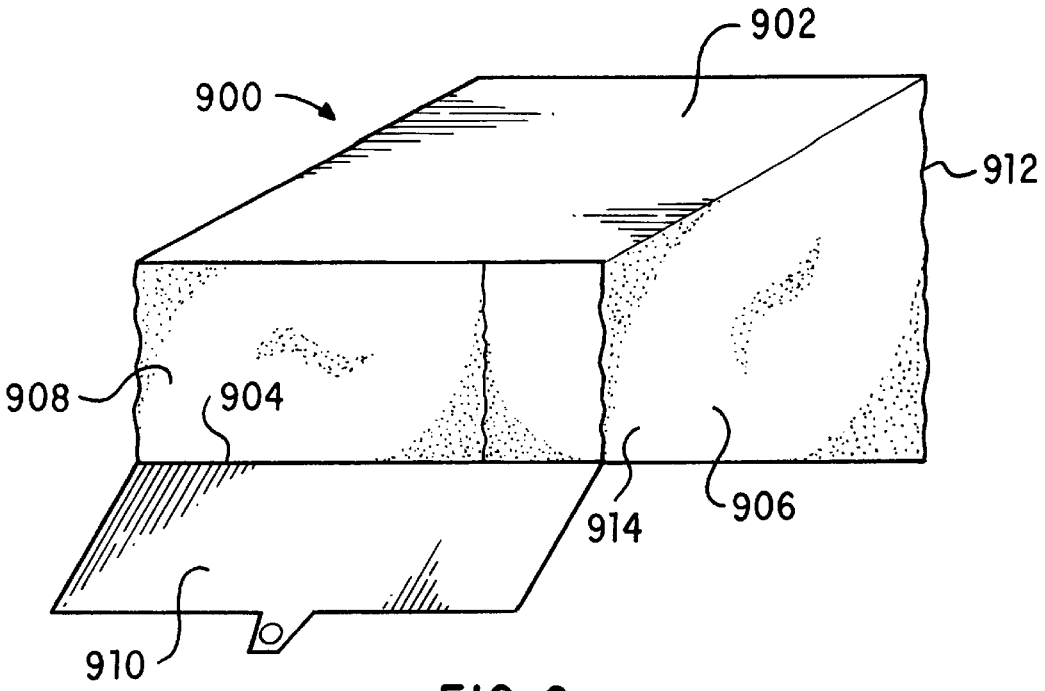
FIG. 9 is a perspective view of a second embodiment of the container for the present invention.

Referring now to FIG. 9 a second embodiment of the container 18 is shown. This embodiment, 900, comprises a container having a top portion 902, a bottom portion 904, side portions 906 and 908 and a bottom flap 910. The top and bottom portions 902, 904 are made of a semi-rigid plastic or like materials. The side portions, on the other hand, comprise a flexible mesh-like cloth. Finally, the closure 910 is made of a flexible plastic which is adapted to be moved up and down. The importance of the mesh fabric sides 906 and 908 is that they provide breathability, and drainage in the event that the container 902 is washed. The fabric sides also enable the container to flexibly expand in order to accommodate a large load. Moreover, the fabric sides 906 and 908 are shaped such that their rear portions 912 are wider than the front portions 914. Thus, the same advantages achieved by sides 202 in the first embodiment (i.e., allowing unfettered passage when the seat is in the upright position and the container is full) are accomplished.

Figure 10:
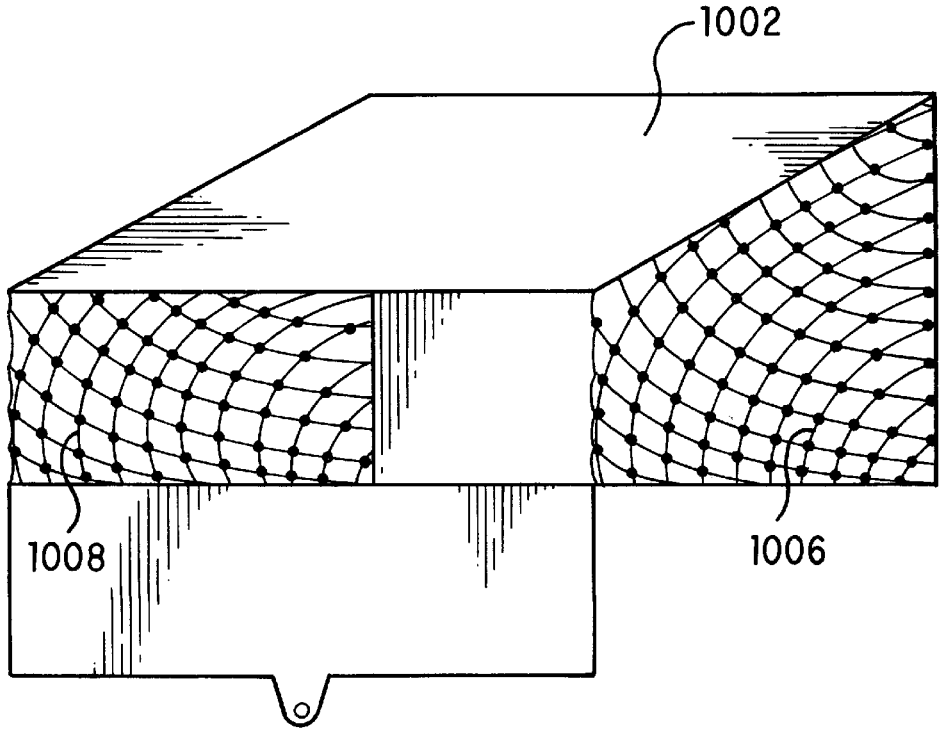
FIG. 10 is a perspective view of a third embodiment of a container for present invention.

FIG. 10 illustrates a third embodiment of the container. In this embodiment, which is similar to FIG. 9, the side portions 1006 and 1008 are made of a net-type material rather than a fabric mesh. The net provides similar advantages to cloth mesh: breathability, expandability and flexibility. However, a further advantage is that the user can see into the container from the sides which obviously provides better visibility.

Figure 11:
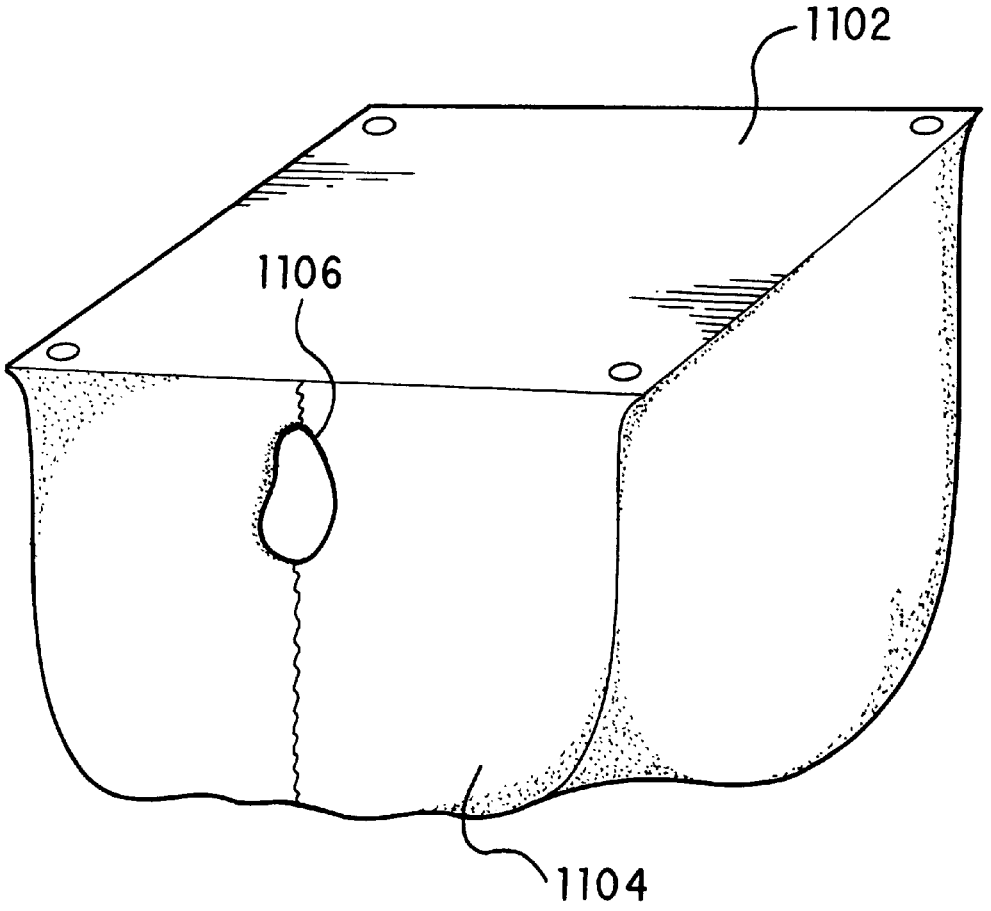
FIG. 11 is a perspective view of a fourth embodiment of a container for the present invention.

FIG. 11 represents a fourth embodiment of the storage container. In this embodiment, a top portion 1102 is made of a semi-rigid plastic material. Secured to the top is a body portion 1104. The body portion 1104 can be secured to the semi-rigid plastic top portion by means of heat fastening, or other appropriate methods to form a permanent bond. The material of the body portion 1104 is an expandable water-resistant fabric-type material, such as Lycra® or Spandex®. The body portion includes an opening 1106 which enables the user to place articles within the container. Because the opening is made from the same material as the body, the opening can be widened to accommodate larger objects and then automatically retract to its naturally smaller size.

Figure 12:
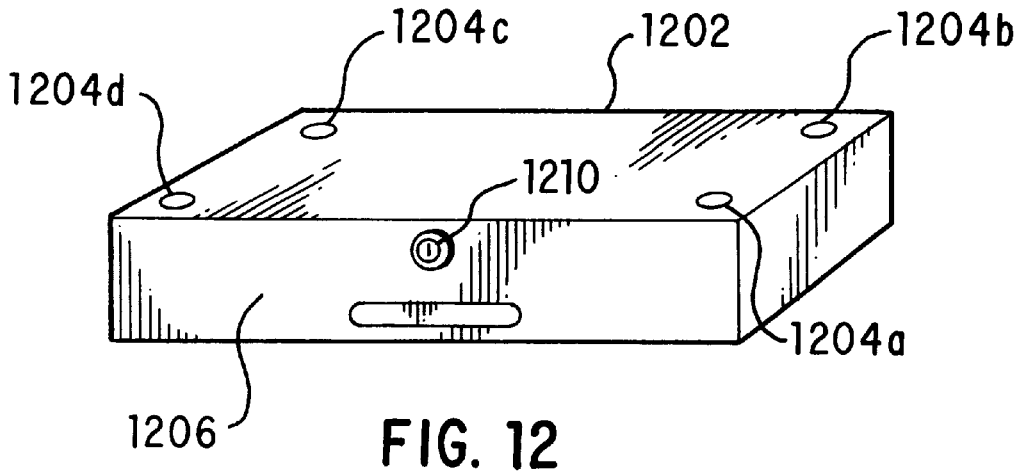
FIG. 12 is a perspective view of a fifth embodiment of a container for the present invention.

FIG. 12 represents a fifth and final embodiment to the present invention. Specifically FIG. 12 illustrates an under seat storage container 1202 made of a plurality rigid materials including wood, plastic, metal. The container 1202 is designed to be connected to the bottom of a seat through connecting anchors 1204A–C. Appropriate anchors for a wooden or metal box may require the use of an anchor bolt, as previously described with respect to the first embodiment. The storage container includes a door portion 1206 which is operated by means of a key-operated lock 1210 located at a central portion of the door. An identification plate may be added, and may be located below the lock. The plate can contain the user's or company's name, seat number or any other appropriate identifier.

The foregoing description of the present embodiments has been presented for the purposes of illustration and description. The description is not intended to limit the invention to the form disclosed herein. Consequently, variations and modifications commensurate with the above teachings and the skill and knowledge of the relevant art are within the scope of the present invention. The multiple embodiments described herein are further intended to explain knowledge for practicing the invention and to enable others skilled in the art to utilize the invention in such, or other, embodiments and with various modifications required by the particular applications or uses of the present invention. It is intended that the appended claims be constructed to include alternative embodiments to the extent permitted by the prior art.

What is claimed is:

1. A seat storage unit, comprising:

a storage unit having top, bottom and side portions and expansion means therein and being configured so that expansion is greater towards a back portion of the storage unit than a front portion of the storage unit, said storage unit being made of a flexible material that is at least partially transparent;

a front clasp, for closing a front portion of the storage unit, said front portion overlying said bottom portion when said storage unit is closed;

a chair connector adapted to securely attach the top portion of the storage unit only to an underside of the seat; and a center storage envelope located on a center portion of the storage unit which is separately releasably attached to the storage unit, wherein said center storage envelope is at least partially transparent.

2. The seat storage unit of claim 1, wherein the storage unit includes openings along the back portion to provide drainage.

3. The seat storage unit of claim 1, wherein, when the seat is in an upright position, the storage unit may be compressed against a back of the seat so that it remains relatively flush with the underside of the seat.

4. The seat storage unit of claim 1, wherein the expansion means comprises side portions configured to fold in an accordion-like fashion.

5. The seat storage unit of claim 1, wherein the expansion means comprises side portions constructed of a flexible mesh-like material which permits liquid to pass through.

6. The seat storage unit of claim 1, wherein the expansion means comprises side portions constructed of a net-type material which permits liquid to pass through.

7. The seat storage unit of claim 1, wherein the flexible material is insulative, so that an interior of the storage unit is maintained at a desired temperature.

8. The seat storage unit of claim 1, wherein the front clasp comprises a strap at least partially coated with a reusable closing material.

9. The seat storage unit of claim 8, wherein the reusable closing material including a hook and loop fastener.

10. The seat storage unit of claim 1, wherein the flexible material is a transparent plastic.

11. The seat storage unit of claim 10, further comprising multiple drainage openings in the storage unit.

12. The seat storage unit of claim 1, wherein the front clasp comprises a first and a second area of reusable closing material, the first area being located on a bottom side of the top portion of the storage unit, and the second area being located along a top side of the bottom portion of the storage unit.

13. The seat storage unit of claim 12, wherein the reusable closing material is a magnet adhesive.

14. The seat storage unit of claim 12, wherein the first area extends substantially along the entire width of the top portion, and the second area extends substantially along the entire width of the bottom portion.

15. The seat storage unit of claim 12, wherein the reusable closing material including a hook and loop fastener.

16. The seat storage unit of claim 12, wherein the reusable closing material is a snap.

* * * * *